US012317987B2

(12) United States Patent
Kamo et al.

(10) Patent No.: US 12,317,987 B2
(45) Date of Patent: Jun. 3, 2025

(54) SHOULDER BELT AND BAG

(71) Applicant: MIZUNO CORPORATION, Osaka (JP)

(72) Inventors: Arata Kamo, Osaka (JP); Yuki Yamada, Osaka (JP); Tetsuya Kanayama, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 130 days.

(21) Appl. No.: 17/923,941

(22) PCT Filed: Feb. 2, 2021

(86) PCT No.: PCT/JP2021/003673
§ 371 (c)(1),
(2) Date: Nov. 8, 2022

(87) PCT Pub. No.: WO2021/240887
PCT Pub. Date: Dec. 2, 2021

(65) Prior Publication Data

US 2023/0172342 A1 Jun. 8, 2023

(30) Foreign Application Priority Data

May 28, 2020 (JP) ..... 2020-093208

(51) Int. Cl.
*A45F 3/04* (2006.01)
*A45F 3/12* (2006.01)

(52) U.S. Cl.
CPC . *A45F 3/04* (2013.01); *A45F 3/12* (2013.01)

(58) Field of Classification Search
CPC ..... A45F 3/04; A45F 3/12
USPC ..... 224/264
See application file for complete search history.

(56) References Cited

U.S. PATENT DOCUMENTS 5,419,475 A * 5/1995 Naritomi ..... A45C 13/30 224/264
5,695,102 A * 12/1997 Jackson ..... A45F 3/02 224/264
5,961,019 A * 10/1999 Gleason ..... A45F 3/12 224/264
6,915,932 B1 * 7/2005 Wolfe ..... A45F 3/12 224/264

(Continued)

FOREIGN PATENT DOCUMENTS

JP 11-46859 A 2/1999
JP 2001-17227 A 1/2001

(Continued)

*Primary Examiner* — Peter N Helvey
(74) *Attorney, Agent, or Firm* — TROUTMAN PEPPER LOCKE LLP; James E. Schutz; Korbin M. Blunck

(57) ABSTRACT

A shoulder belt has a longitudinal direction and a transverse direction intersecting the longitudinal direction, and includes a first section and a second section spaced apart from each other in the transverse direction in a cross section intersecting the longitudinal direction, and a third section connecting between the first section and the second section. An expansion and contraction ratio of the third section is higher than each expansion and contraction ratio of the first section and the second section. Bending resistance of the third section is lower than each bending resistance of the first section and the second section.

8 Claims, 14 Drawing Sheets

(56) References Cited

U.S. PATENT DOCUMENTS

| | | | | |
|---|---|---|---|---|
| 7,004,363 | B2 * | 2/2006 | Fenton | B32B 3/30 224/264 |
| 8,807,405 | B2 * | 8/2014 | Crandall | A45F 3/12 224/264 |
| 2005/0098590 | A1 * | 5/2005 | Collier | A63B 55/408 224/264 |
| 2005/0258205 | A1 * | 11/2005 | French | A45F 3/12 224/264 |
| 2007/0262106 | A1 * | 11/2007 | Fidrych | A45F 3/12 224/264 |
| 2012/0325872 | A1 * | 12/2012 | Mutoh | A45F 3/10 224/264 |

FOREIGN PATENT DOCUMENTS

| | | | |
|---|---|---|---|
| JP | 2004-065462 | * | 3/2004 |
| JP | 2004-65462 A | | 3/2004 |

* cited by examiner

SHOULDER BELT AND BAG

TECHNICAL FIELD

The present invention relates to a shoulder belt and a bag.

BACKGROUND ART

In order to reduce a burden on a shoulder, attempts have been made to increase a contact area between a shoulder belt and the shoulder, disperse a load, and reduce a pressure.

Japanese Patent Laying-Open No. 2001-17227 proposes a shoulder belt including both ends including a core material and a center including a band-shaped tape and connecting both ends in a cross section of the shoulder belt in a longitudinal direction in order to make the shoulder belt follow a complex three-dimensional shape of a body. Further, Japanese Patent Laying-Open No. 2001-17227 discloses that a tough material such as polypropylene is used for the band-shaped tape in order to bear a strength of the shoulder belt.

CITATION LIST

Patent Literature

PTL 1: Japanese Patent Laying-Open No. 2001-17227

SUMMARY OF INVENTION

Technical Problem

The shoulder belt can follow the three-dimensional shape of the body and disperse the load when the arm is passed through the shoulder belt, is lowered, and is not moving, and the shoulder and the arm of the wearer are in a static state. On the other hand, when the shoulder and the arm of the wearer are in a dynamic state such as when the wearer raises and lowers the arm, the shoulder belt cannot sufficiently follow the change in the three-dimensional shape, and the contact area between the shoulder belt and the shoulder may be reduced.

As a result of studies by the inventors, it has been considered that the reason is that both ends and the center tend to be flat due to high rigidity of the center including the band-shaped tape, and do not expand or contract well.

A main object of the present invention is to provide a shoulder belt in which a contact area between a shoulder belt and a shoulder is not reduced even when the shoulder and the arm of a wearer are in a dynamic state such as when the arm is raised and lowered as compared with a conventional shoulder belt, and a bag including the shoulder belt.

Solution to Problem

A shoulder belt of the present invention has a longitudinal direction and a transverse direction intersecting the longitudinal direction, and includes a first section and a second section spaced apart from each other in the transverse direction in a cross section intersecting the longitudinal direction, and a third section connecting between the first section and the second section. An expansion and contraction ratio of the third section is higher than each expansion and contraction ratio of the first section and the second section. Bending resistance of the third section is lower than each bending resistance of the first section and the second section.

In the shoulder belt, the first section and the second section extend along the longitudinal direction. The third section extends between a first end and a second end of each of the first section and the second section in the longitudinal direction.

In the shoulder belt, the first section, the second section, and the third section extend between the first end and the second end in the longitudinal direction of the shoulder belt.

In the shoulder belt, the third section includes a first portion disposed inside of the first section and connected to the first section, a second portion disposed inside of the second section and connected to the second section, and a third portion disposed outside of the first portion and the second portion and connecting the first portion and the second portion to each other. Each of the first section and the second section includes a core material disposed to overlap at least a part of the first portion or the second portion in plan view, and a packaging material disposed to surround the first portion or the second portion and the core material in the cross section and fixed to the first portion or the second portion.

A bag of the present invention includes the shoulder belt, and a body compartment fixed to the first end and the second end of the shoulder belt in the longitudinal direction. The bag is, for example, a backpack or a golf bag.

Advantageous Effects of Invention

The present invention can provide a shoulder belt in which a contact area between a shoulder belt and the shoulder is not reduced even when the shoulder and the arm of a wearer are in a dynamic state such as when the arm is raised and lowered as compared with a conventional shoulder belt, and a bag including the shoulder belt.

DESCRIPTION OF EMBODIMENTS

Hereinafter, an embodiment of the present invention will be described with reference to the drawings. In the following drawings, the same or corresponding parts are denoted by the same reference signs, and the description thereof will not be repeated.

Figure 4:
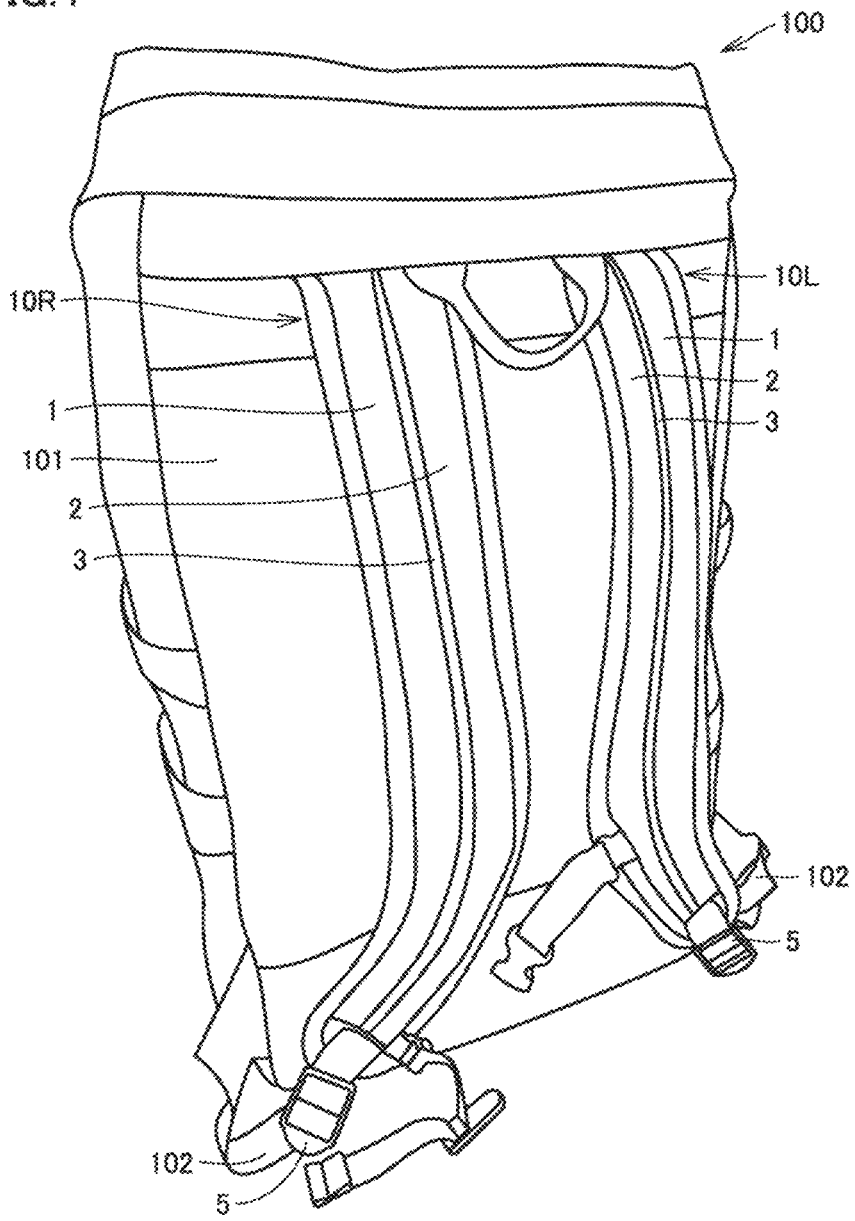
FIG. 4 is a diagram of a backpack as an example of a bag including the shoulder belt according to the embodiment.

A shoulder belt according to the embodiment is attached to a bag and allows a shoulder and arm of a wearer to pass through. A shoulder belt 10L illustrated in FIGS. 1 and 2 allows a left arm, shoulder, and chest of a wearer to pass through in a shoulder bag 100 illustrated in FIG. 4. In shoulder bag 100 illustrated in FIG. 4, a shoulder belt 10R through which an arm, shoulder, and chest on a right side of the wearer pass has a bilaterally symmetrical relationship with shoulder belt 10L. Hereinafter, in shoulder belt 10L, an outer side of bag 100 illustrated in FIG. 4 is referred to as front side, the opposite side is referred to as reverse side, a surface on the front side is referred to as front surface, and a surface on the reverse side is referred to as reverse surface.

Figure 1:
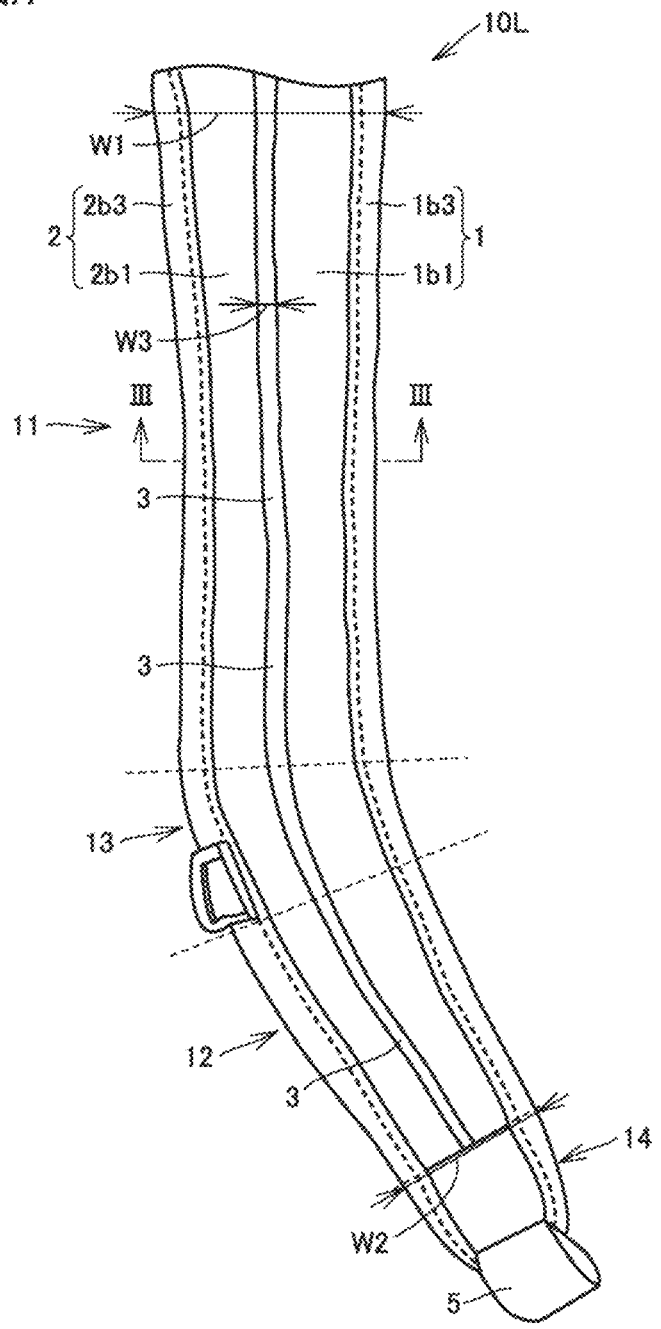
FIG. 1 is a front view of a shoulder belt according to an embodiment.
Figure 2:
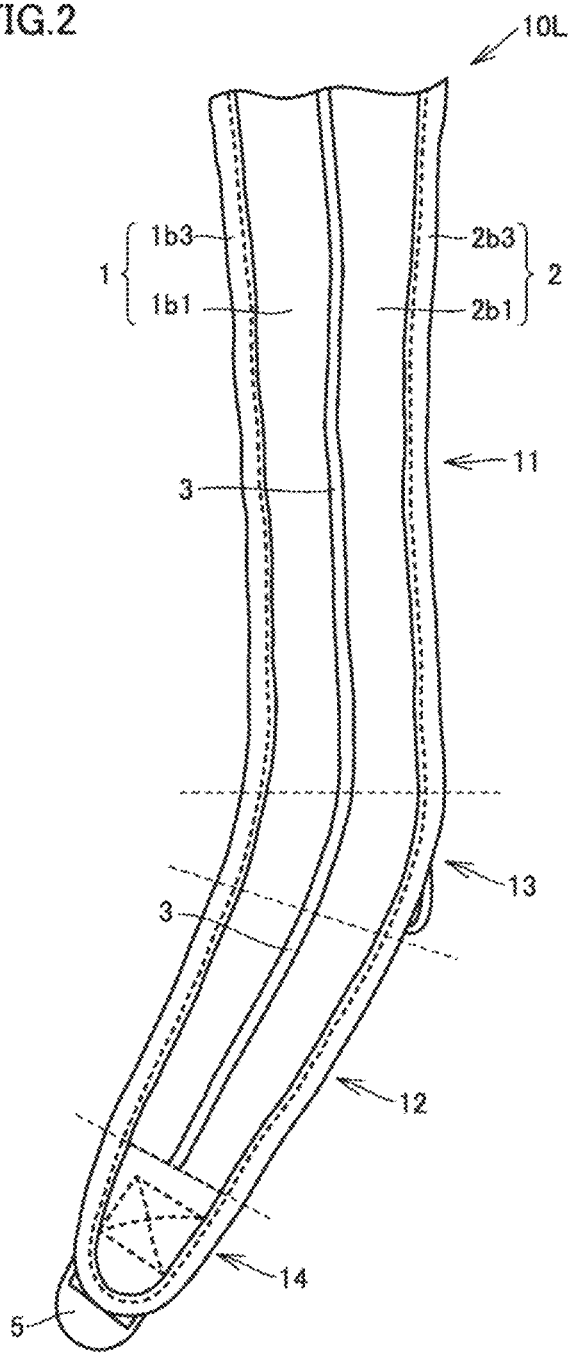
FIG. 2 is a rear view of the shoulder belt according to the embodiment.

As illustrated in FIGS. 1 and 2, shoulder belt 10L has a longitudinal direction and a transverse direction intersecting the longitudinal direction.

Figure 3:
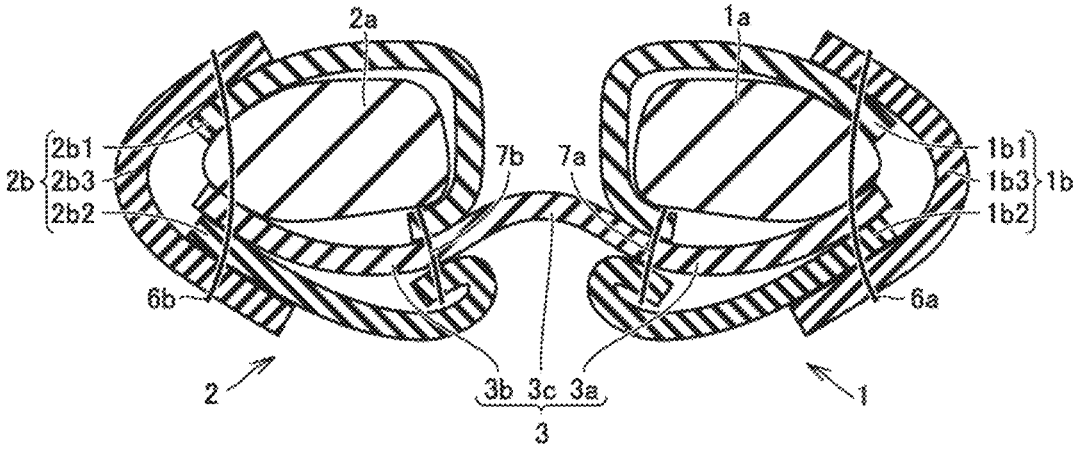
FIG. 3 is a sectional view as viewed from an arrow III-III in FIG. 1.

As illustrated in FIGS. 1 to 3, shoulder belt 10L includes a first section 1, a second section 2, and a third section 3. First section 1 and second section 2 extend along the longitudinal direction. Third section 3 extends between a first end and a second end of each of first section 1 and second section 2 in the longitudinal direction. In other words, third section 3 closes a space between first section 1 and second section 2.

As illustrated in FIG. 3, in a cross section intersecting the longitudinal direction, first section 1 and second section 2 are spaced apart from each other in the transverse direction. Third section 3 connects between first section 1 and second section 2. First section 1 is disposed outside of third section 3 in bag 100 illustrated in FIG. 4. Second section 2 is disposed inside of third section 3 in bag 100 illustrated in FIG. 4. Third section 3 is disposed between first section 1 and second section 2 in bag 100 illustrated in FIG. 4.

An expansion and contraction ratio of third section 3 is higher than each expansion and contraction ratio of first section 1 and second section 2. Here, each expansion and contraction ratio of first section 1, second section 2, and third section 3 is an extension modulus defined in Japanese Industrial Standard (JIS L 1096:2010), and is measured on the basis of, for example, B-1 method (fixed loading method) defined in the Standard.

A flexibility of third section 3 is higher than each flexibility of first section 1 and second section 2. That is, third section 3 is softer than each of first section 1 and second section 2. Each flexibility of first section 1, second section 2, and third section 3 is, for example, bending resistance defined in JIS (JIS L 1096:2010), and is measured on the basis of, for example, A method (45° cantilever method) defined in the Standard. That is, bending resistance of third section 3 is lower than each bending resistance of first section 1 and second section 2.

As illustrated in FIGS. 1 and 2, shoulder belt 10L is divided into, for example, a first region 11, a second region 12, a third region 13, and a fourth region 14 in the longitudinal direction. First region 11 is connected to second region 12 with third region 13 interposed therebetween. Fourth region 14 is disposed opposite to third region 13 with respect to second region 12, and is connected to second region 12. In other words, first region 11, third region 13, second region 12, and fourth region 14 are connected in this order. Each of first section 1, second section 2, and third section 3 extends from first region 11 to second region 12 in the longitudinal direction of shoulder belt 10L.

Note that first region 11 is a region to be in contact with the shoulder and an upper part of the chest of the wearer when bag 100 illustrated in FIG. 4 is worn. Second region 12 is a region to be in contact with a flank of the wearer when bag 100 illustrated in FIG. 4 is worn. Third region 13 is a region to be in contact with a lower part of the chest and the flank of the wearer when bag 100 illustrated in FIG. 4 is worn. A linking member 5 linked to a tape 102 fixed to a lower back surface of a body compartment 101 of bag 100 illustrated in FIG. 4 is fixed to fourth region 14.

Basic configurations of first region 11, second region 12, and third region 13 are the same. First section 1, second section 2, and third section 3 are disposed in each of first region 11, second region 12, and third region 13.

In other words, in each of first region 11, second region 12, and third region 13, basic configurations of first section 1, second section 2, and third section 3 are the same.

In first region 11, first section 1, second section 2, and third section 3 extend along a longitudinal direction of first region 11. In second region 12, first section 1, second section 2, and third section 3 extend along a longitudinal direction of second region 12. The longitudinal direction of first region 11 and the longitudinal direction of second region 12 are along the longitudinal direction of shoulder belt 10L. A transverse direction of first region 11 and a transverse direction of second region 12 are along the transverse direction of shoulder belt 10L.

The longitudinal direction of first region 11 is set so as to be gently curved with respect to the longitudinal direction of second region 12. In other words, shoulder belt 10L has a curved portion in plan view.

A length of second region 12 in the longitudinal direction is shorter than a length of first region 11 in the longitudinal direction, and is longer than a length of third region 13 in the longitudinal direction. A width in a transverse direction of third region 13 is preferably equal to or narrower than a maximum width W1 in the transverse direction of first region 11 and wider than a minimum width W2 in the transverse direction of second region 12.

A width W3 in a transverse direction of third section 3 in first region 11 is desirably greater than or equal to width W3 in the transverse direction of third section 3 in second region 12.

In one example of shoulder belt 10L, maximum width W1 in the transverse direction of first region 11 is desirably 50 mm or more and 90 mm or less, minimum width W2 in the transverse direction of second region 12 is desirably 30 mm or more and 70 mm or less, and width W3 in the transverse direction of third section 3 is desirably 5 mm or more and 15 mm or less.

As illustrated in FIGS. 1 to 3, each of first section 1 and second section 2 is configured as, for example, an assembly of a plurality of members.

As illustrated in FIG. 3, third section 3 includes a first portion 3*a* disposed inside of first section 1 and connected to first section 1, a second portion 3*b* disposed inside of second section 2 and connected to second section 2, and a third portion 3*c* disposed outside of first portion 3*a* and second portion 3*b* and connecting first portion 3*a* and second portion 3*b* to each other. In third section 3, only third portion 3*c* is exposed.

As illustrated in FIG. 3, first section 1 includes a core material 1*a* and a packaging material 1*b*. Core material 1*a* is disposed so as to overlap at least a part of first portion 3*a* of third section 3 in plan view. Packaging material 1*b* is disposed so as to surround first portion 3*a* and core material 1*a* in a cross section perpendicular to the longitudinal direction, and is fixed to first portion 3*a*. Packaging material 1*b* has, for example, a front surface 1*b*1, a reverse surface 1*b*2, and an outer edge 1*b*3. Note that packaging material 1*b* need not have outer edge 1*b*3. Front surface 1*b*1 is disposed on a side of core material 1*a* with respect to first portion 3*a* in the cross section. Reverse surface 1*b*2 is disposed opposite to core material 1*a* with respect to first portion 3*a* in the cross section. Outer edge 1*b*3 is disposed outside of first portion 3*a* of third section 3, core material 1*a*, front surface 1*b*1, and reverse surface 1*b*2 in the cross section. First portion 3*a* of third section 3, front surface 1*b*1, and outer edge 1*b*3 are disposed so as to surround core material 1*a*.

As illustrated in FIG. 3, first portion 3*a* of third section 3, core material 1*a*, front surface 1*b*1, reverse surface 1*b*2, and outer edge 1*b*3 are sewn to each other by a sewing member 6*a*, for example. For example, sewing member 6*a* sews outer parts of first portion 3*a*, core material 1*a*, front surface 1*b*1, and reverse surface 1*b*2 and an inner part of outer edge 1*b*3 to each other. Further, first portion 3*a* of third section 3, front surface 1*b*1, and reverse surface 1*b*2 are sewn to each other by a sewing member 7*a*, for example. Sewing member 7*a* sews, for example, inner parts of first portion 3*a*, front surface 1*b*1, and reverse surface 1*b*2 to each other.

As illustrated in FIG. 3, second section 2 has a substantially line-symmetric relationship with first section 1 with respect to third portion 3*c* of third section 3 in the cross section, for example. Note that second section 2 need not have a substantially line-symmetric relationship with first section 1 with respect to third portion 3*c* of third section 3 in the cross section. For example, the widths of the first section and the second section in the transverse direction may be different from each other.

As illustrated in FIG. 3, second section 2 includes a core material 2*a* and a packaging material 2*b*. Core material 2*a* is disposed so as to overlap at least a part of second portion 3*b* of third section 3 in plan view. Packaging material 2*b* is disposed so as to surround second portion 3*b* and core material 2*a* in the cross section perpendicular to the longitudinal direction, and is fixed to second portion 3*b*. Packaging material 2*b* has, for example, a front surface 2*b*1, a reverse surface 2*b*2, and an outer edge 2*b*3. Note that packaging material 2*b* need not have outer edge 2*b*3. Front surface 2*b*1 is disposed on a side of core material 2*a* with respect to second portion 3*b* in the cross section. Reverse surface 2*b*2 is disposed opposite to core material 2*a* with respect to second portion 3*b* in the cross section. Outer edge 2*b*3 is disposed outside of second portion 3*b* of third section 3, core material 2*a*, front surface 2*b*1, and reverse surface 2*b*2 in the cross section. Second portion 3*b* of third section 3, front surface 2*b*1, and outer edge 2*h*3 are disposed so as to surround core material 2*a*.

As illustrated in FIG. 3, second portion 3*b* of third section 3, core material 2*a*, front surface 2*b*1, reverse surface 2*b*2, and outer edge 2*b*3 are sewn to each other by a sewing member 6*b*, for example. For example, sewing member 6*b* sews outer parts of second portion 3*b*, core material 2*a*, front surface 2*b*1, and reverse surface 2*b*2 and an inner part of outer edge 2*b*3 to each other. Further, second portion 3*b* of third section 3, front surface 2*b*1, and reverse surface 2*b*2 are sewn to each other by a sewing member 7*b*, for example. For example, sewing member 7*b* sews inner parts of second portion 3*b*, front surface 2*b*1, and reverse surface 2*b*2 to each other.

In one example of shoulder belt 10L, a material constituting third section 3 includes at least one selected from the group consisting of a mesh, an air mesh, a knit, and a stretch material. A material constituting core material 1*a* includes at least one selected from the group consisting of EPE, EVA, and sponge. A material constituting packaging material 1*b* includes at least one selected from the group consisting of PU, polyester, nylon, cotton, acrylic, and TPU. A plurality of members included in each of first section 1 and second section 2 need not be fixed to each other by sewing, but may be fixed to each other by any method such as adhesion.

As illustrated in FIG. 4, bag 100 including shoulder belt 10L is configured as, for example, a backpack. As illustrated in FIG. 4, bag 100 includes shoulder belt 10L, shoulder belt 10R, and body compartment 101 illustrated in FIGS. 1 to 3. First region 11 of shoulder belt 10L is connected to an upper part of body compartment 101. Linking member 5 of shoulder belt 10L is linked to tape 102 fixed to a lower part of body compartment 101. For example, tape 102 fixed to the lower part of body compartment 101 is passed through linking member 5 of shoulder belt 10L. Preferably, linking member 5 and tape 102 are provided so as to adjust a length between one end of tape 102 fixed to body compartment 101 and a part passed through linking member 5.

Although shoulder belts 10L and 10L illustrated in FIGS. 1 to 4 each have a curved portion in plan view, the shoulder belt according to the embodiment need not have the curved portion in plan view.

Figure 5:
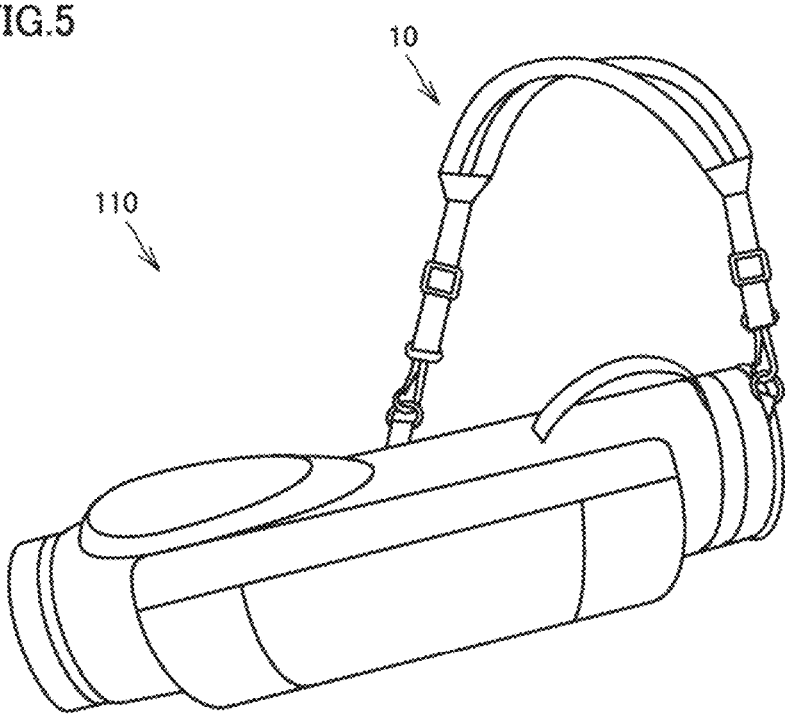
FIG. 5 is a diagram of a golf bag as another example of the bag including the shoulder belt according to the embodiment.

FIG. 5 illustrates a bag 110 including shoulder belt 10 having no curved portion in plan view. Shoulder belt 10 has a configuration basically similar to a configuration of shoulder belt 10L, but is different from shoulder belt 10L in that shoulder belt 10 does not have the curved portion in plan view. Bag 110 is configured as, for example, a golf bag.

Next, functions and effects of shoulder belts 10L, 10R, and 10 according to the embodiment will be described. First, with reference to FIGS. 6 to 10, functions and effects of shoulder belts 10L, 10R, and 10 when the shoulder and arm of the wearer are in a static state will be described in comparison with a comparative example illustrated in FIGS. 17 to 19.

Figure 6:
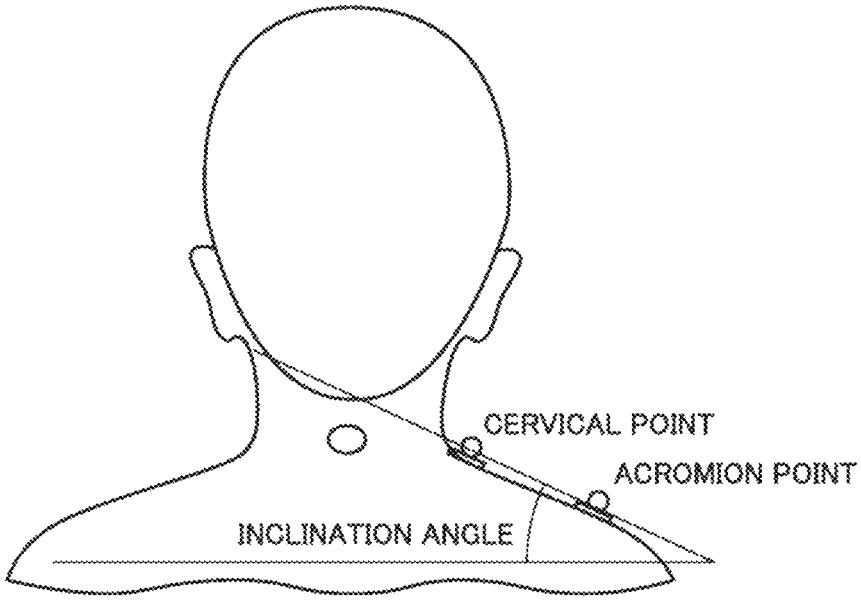
FIG. 6 is a schematic view for describing a cervical point and an acromion point of a wearer, and an inclination angle of the cervical point and the acromion point with respect to a horizontal plane.

Shoulder belts 10L, 10R, and 10 are to be into contact with at least a part of a region located between the cervical point and the acromion point of the wearer illustrated in FIG. 6. Third section 3 is to be disposed so as to overlap a part of the region located between the cervical point and the acromion point of the wearer.

An inclination angle formed by a virtual line segment connecting the cervical point and the acromion point with respect to the horizontal plane and a distance between the cervical point and the acromion point are different for each wearer.

Figure 17:
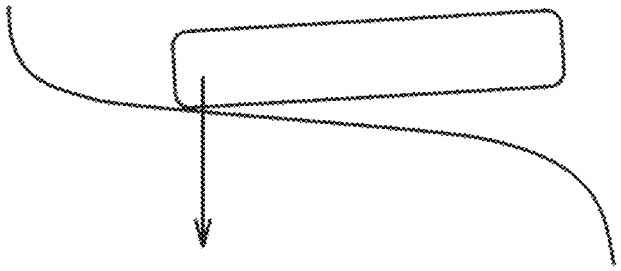
FIG. 17 is a schematic view illustrating a contact state between an outer side and an inner side of a shoulder belt according to a comparative example and the shoulder when the inclination angle of the cervical point and the acromion point with respect to the horizontal plane is relatively small (so-called square shoulders).
Figure 18:
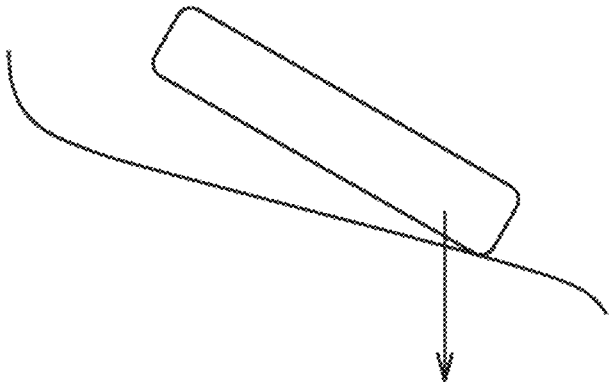
FIG. 18 is a schematic view illustrating a contact state between the outer side and the inner side of the shoulder belt according to the comparative example and the shoulder when the inclination angle of the cervical point and the acromion point with respect to the horizontal plane is relatively large (so-called sloping shoulders).

The shoulder belt according to the comparative example illustrated in FIGS. 17 and 18 does not include third section 3. In the shoulder belt according to the comparative example, the expansion and contraction ratios of an outer side and an inner side are equal to the expansion and contraction ratios of both ends in the transverse direction. In the shoulder belt according to the comparative example, the flexibility of a center in the transverse direction is equal to the flexibility of both ends in the transverse direction. As illustrated in FIG. 17, when the shoulder belt according to the comparative example is worn on a wearer with so-called square shoulders having a relatively small inclination angle, an end of the shoulder belt in the transverse direction is likely to be in contact with only a vicinity of the cervical point. Thus, a load of the bag tends to concentrate on the vicinity of the cervical point. Further, as illustrated in FIG. 18, when the shoulder belt according to the comparative example is worn by a wearer with so-called sloping shoulders having a relatively large inclination angle, the shoulder belt is likely to be in contact with only a vicinity of the acromion point. Thus, the load of the bag tends to concentrate on the vicinity of the acromion point. As described above, in the shoulder belt according to the comparative example, it is difficult to widely disperse the load between the cervical point and the acromion point depending on the inclination angle.

On the other hand, shoulder belts 10L, 10R, and 10 according to the embodiment include third section 3, the expansion and contraction ratio of third section 3 is higher than each expansion and contraction ratio of first section 1 and second section 2, and the bending resistance of third section 3 is lower than each bending resistance of first section 1 and second section 2. Therefore, third section 3 is easily deformed in the transverse direction and in a direction orthogonal to each of the longitudinal direction and the transverse direction, and a relative positional relationship between first section 1 and second section 2 in the transverse direction and the orthogonal direction can be easily changed.

Figure 7:
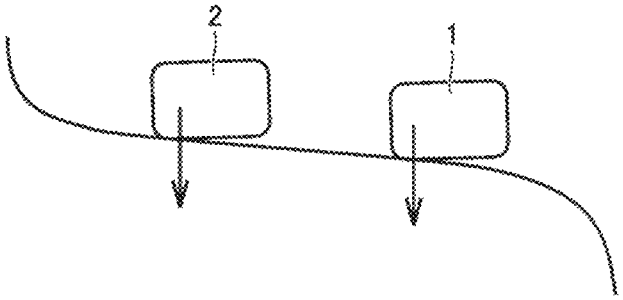
FIG. 7 is a schematic view illustrating a contact state between a first section and a second section of the shoulder belt according to the embodiment and a shoulder when the inclination angle of the cervical point and the acromion point with respect to the horizontal plane is relatively small (so-called square shoulders).
Figure 8:
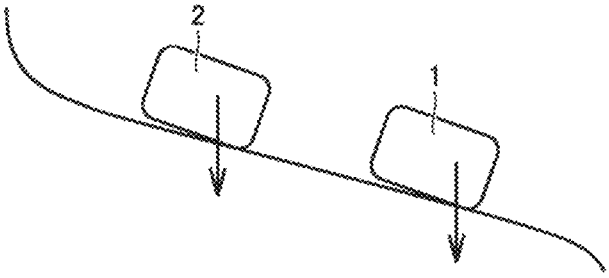
FIG. 8 is a schematic view illustrating a contact state between the first section and the second section of the shoulder belt according to the embodiment and the shoulder when the inclination angle of the cervical point and the acromion point with respect to the horizontal plane is relatively large (so-called sloping shoulders).

As illustrated in FIG. 7, when shoulder belts 10L, 10R, and 10 according to the embodiment are worn by a wearer with so-called square shoulders having a relatively small inclination angle, first section 1 can be in contact with the vicinity of the acromion point, and second section 2 can be in contact with the vicinity of the cervical point. Further, as illustrated in FIG. 8, even when shoulder belts 10L, 10R, and 10 according to the embodiment are worn by a wearer with so-called sloping shoulders having a relatively large inclination angle, first section 1 can be in contact with the vicinity of the acronion point, and second section 2 can be in contact with the vicinity of the cervical point. As described above, shoulder belts 10L, 10R, and 10 according to the embodiment can widely disperse the load between the cervical point and the acromion point regardless of the inclination angle. Note that in FIGS. 7 and 8, only first section 1 and second section 2 are schematically illustrated.

Figure 9:
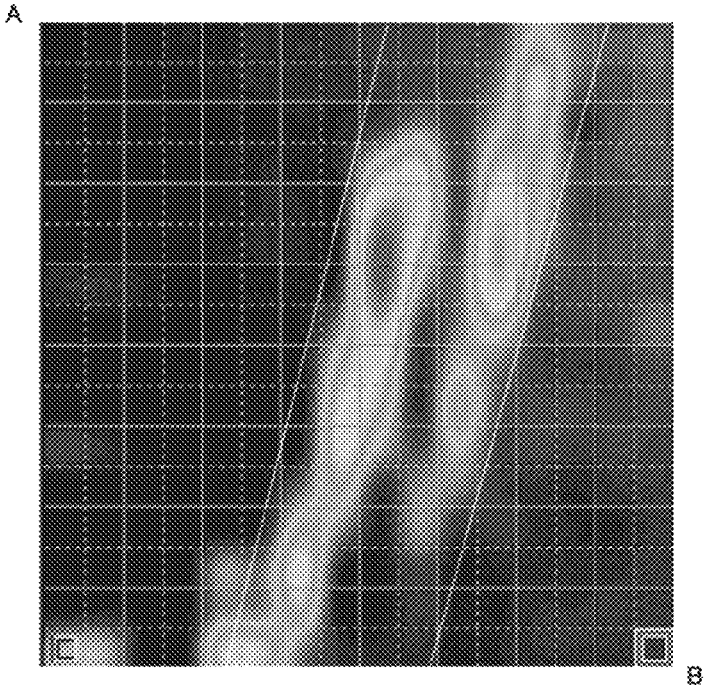
FIG. 9 is a diagram illustrating a load distribution applied to the shoulder measured by using a flexible piezoelectric sensor in a case illustrated in FIG. 8.
Figure 10:
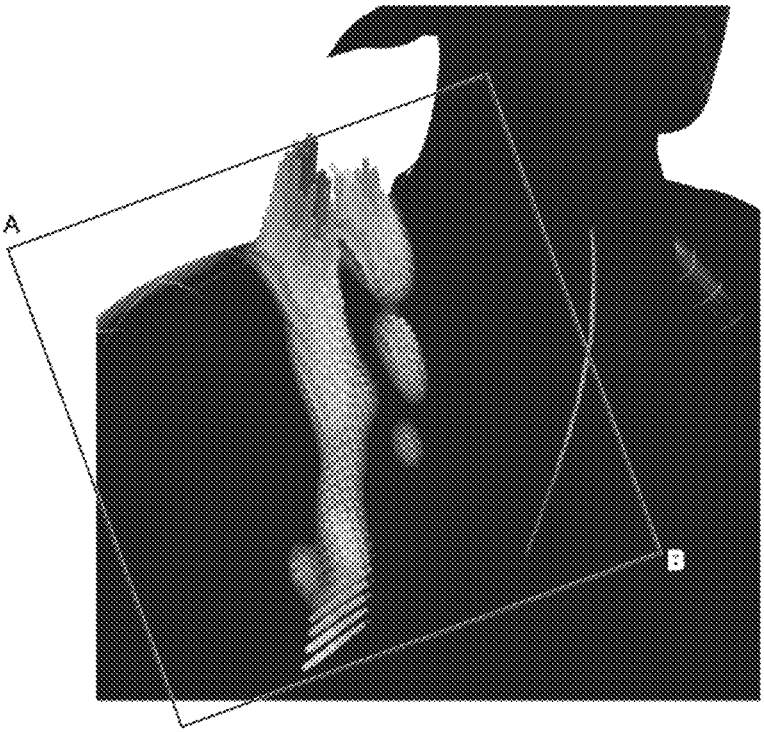
FIG. 10 is a diagram three-dimensionally illustrating the load distribution applied to the shoulder measured by using the flexible piezoelectric sensor in the case illustrated in FIG. 8.
Figure 19:
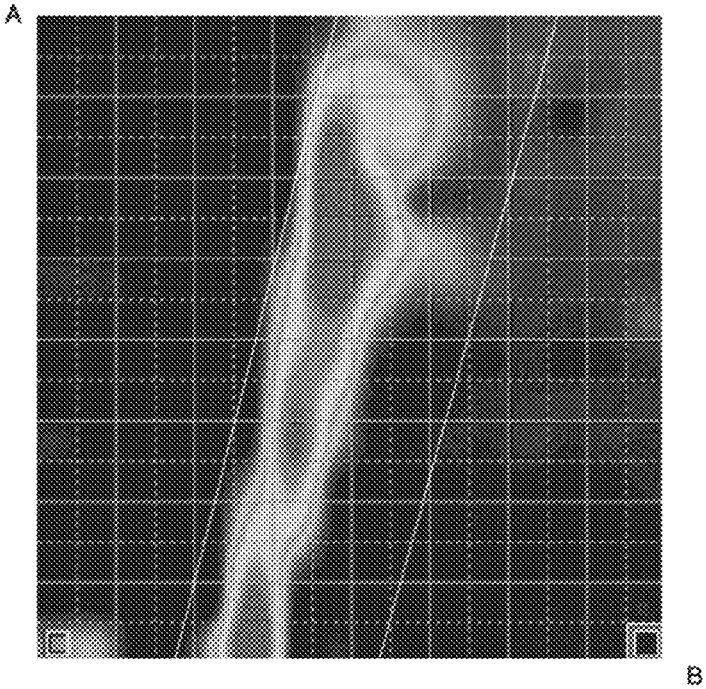
FIG. 19 is a diagram illustrating the load distribution applied to the shoulder measured by using the flexible piezoelectric sensor in a case illustrated in FIG. 18.
Figure 20:
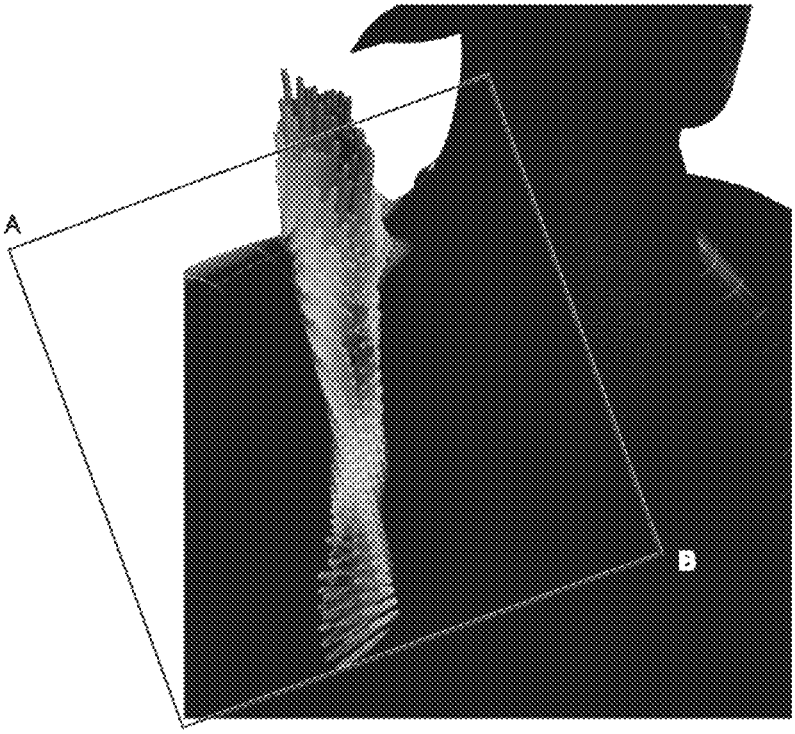
FIG. 20 is a diagram three-dimensionally illustrating the load distribution applied to the shoulder measured by using the flexible piezoelectric sensor in the case illustrated in FIG. 18.

FIGS. 9, 10, 19, and 20 are diagrams illustrating a load distribution applied to the shoulder of the same wearer measured under the same condition for each of shoulder belt 10L and the shoulder belt according to the comparative example. As illustrated in FIGS. 8 and 18, the wearer has sloping shoulders with a relatively large inclination angle. The load distribution was measured by using a flexible piezoelectric sensor fixed to the shoulder of the wearer. Corners A and B of a measurement region illustrated in FIGS. 9 and 19 correspond to corners A and B of a measurement region in FIGS. 10 and 20, respectively. In FIGS. 9 and 19, the right side represents the cervical point, and the left side represents the acromion point. In FIGS. 9 and 19, an upper side represents the back of the wearer, and a lower side represents the chest of the wearer. In FIGS. 9 and 19, a region to which no load is applied is indicated by the same color as a background color (a color of a region outside of two inclined lines), and a shade of a color of the other region indicates a magnitude of the load applied to the region. In FIGS. 10 and 20, a height and color density of a plurality of pieces of bar-shaped data protruding outward from a body surface indicate the magnitude of the load applied to the region. In FIGS. 9 and 19, the inclination line located on the right side indicates passing through the cervical point, and the inclination line located on the left side indicates passing through the acromion point.

As illustrated in FIGS. 19 and 20, in the shoulder belt according to the comparative example, the load is concentrated in the vicinity of the acromion point, and a relatively large load is applied to a region where the load is applied.

On the other hand, as illustrated in FIGS. 9 and 10, in shoulder belt 10L, the load was dispersed in the vicinity of the cervical point and the vicinity of the acromion point, and a maximum load applied to a plurality of regions to which the load is applied is smaller than a maximum load measured by the shoulder belt according to the comparative example.

As described above, it has been confirmed that shoulder belts 10L, 10R, and 10 according to the embodiment can follow a complex three-dimensional shape of a body in the static state as compared with the shoulder belt according to the comparative example.

Next, functions and effects of shoulder belts 10L, 10R, and 10 when the shoulder and arm of the wearer are in a dynamic state will be described with reference to FIGS. 1 to 16.

Figure 11:
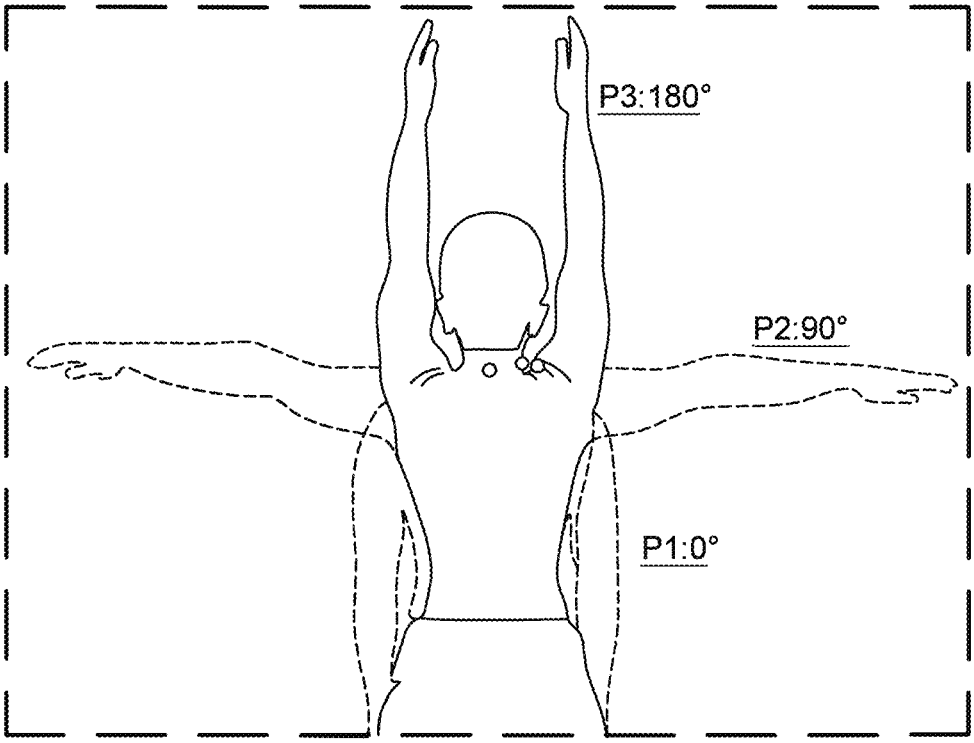
FIG. 11 is a view for describing a first state (P1) in which the arm is lowered, a second state (P2) in which the arm is raised along a horizontal direction, and a third state (P3) in which the arm is raised along a vertical direction.

FIGS. 11 to 14 are diagrams for describing that the distance between the cervical point and the acromion point varies in the dynamic state. As illustrated in FIG. 11, a first state P1 in which the arm is lowered, a second state P2 in which the arm is raised along a horizontal direction, and a third state P3 in which the arm is raised along a vertical direction are considered.

Figure 12:
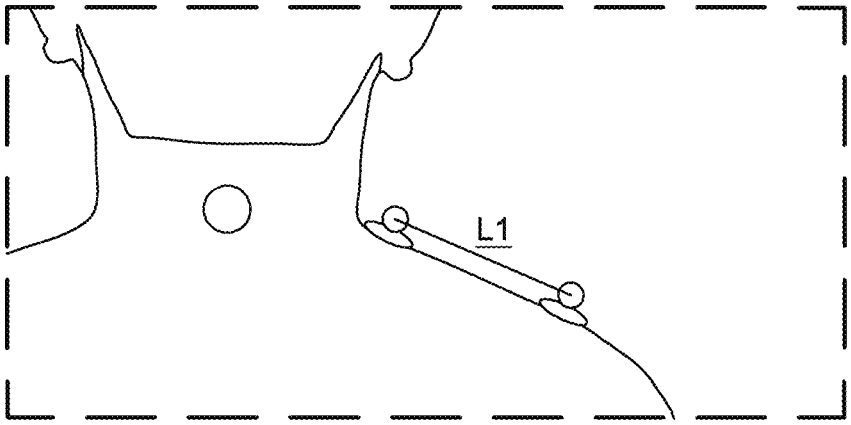
FIG. 12 is a view illustrating a distance between the cervical point and the acromion point in the first state illustrated in FIG. 11.
Figure 13:
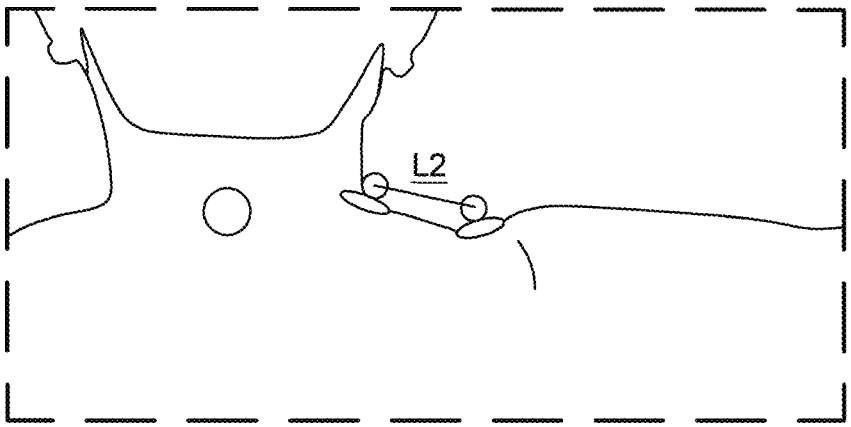
FIG. 13 is a view illustrating a distance between the cervical point and the acromion point in the second state illustrated in FIG. 11.
Figure 14:
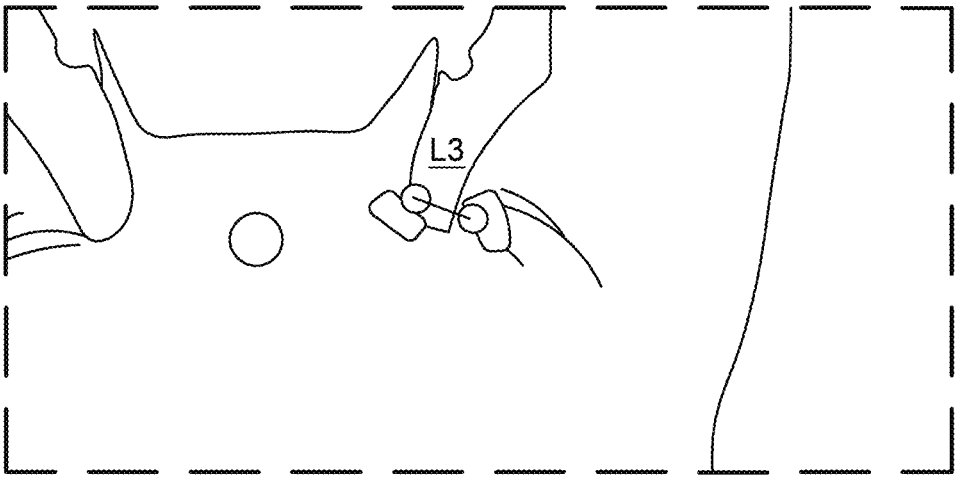
FIG. 14 is a view illustrating a distance between the cervical point and the acromion point in the third state illustrated in FIG. 11.

As illustrated in FIGS. 12 to 14, a distance L2 (see FIG. 13) between the cervical point and the acromion point in second state P2 is shorter than a distance L1 (see FIG. 12) between the cervical point and the acromion point in first state P1, and is longer than a distance L3 (see FIG. 14) between the cervical point and the acromion point in third state P3.

Table 1 shows individual differences of distance L1, distance L2, and distance L3. For each of six subjects, distance L1, distance L2, and distance L3 were measured, and a change rate of each distance was calculated.

TABLE 1

| Subject | L1 (cm) | L2 (cm) | L3 (cm) | (L2 − L1)/L1 | (L3 − L1)/L1 |
|---|---|---|---|---|---|
| 1 | 11.5 | 6.4 | 4.1 | −44.5% | −64.2% |
| 2 | 10.7 | 6.7 | 2.3 | −37.5% | −78.9% |
| 3 | 8.3 | 4.8 | 2.6 | −42.3% | −69.1% |
| 4 | 10.1 | 6.7 | 4.2 | −34.0% | −58.1% |
| 5 | 9.8 | 5.1 | 2.8 | −48.4% | −71.6% |
| 6 | 9.5 | 5.7 | 3.3 | −40.3% | −64.9% |

As illustrated in Table 1, for all the subjects, distance L2 was shorter than distance L1 and longer than distance L3. A ratio (L2−L1)/L1 was greater than or equal to 30% in terms of absolute value for all the subjects, and a ratio (L3−L1)/L1 was greater than or equal to 50% in terms of absolute value for all the subjects. That is, for all the subjects, it was confirmed that the distance between the cervical point and the acromion point greatly changes in the dynamic state. Further, individual differences were confirmed in each of distance L1, distance L2, distance L3, ratio (L2−L1)/L1, and ratio (L3−L1)/L1.

As described above, the shoulder belts according to the embodiment include third section 3, the expansion and contraction ratio of third section 3 is higher than each expansion and contraction ratio of first section 1 and second section 2, and the bending resistance of third section 3 is lower than each bending resistance of first section 1 and second section 2. Therefore, third section 3 is easily deformed in the transverse direction and in a direction orthogonal to each of the longitudinal direction and the transverse direction, and a relative positional relationship between first section 1 and second section 2 in the transverse direction and the orthogonal direction can be easily changed. Therefore, shoulder belts 10L, 10R, and 10 according to the embodiment can follow the change in the three-dimensional shape of the body in the dynamic state.

Figure 15:
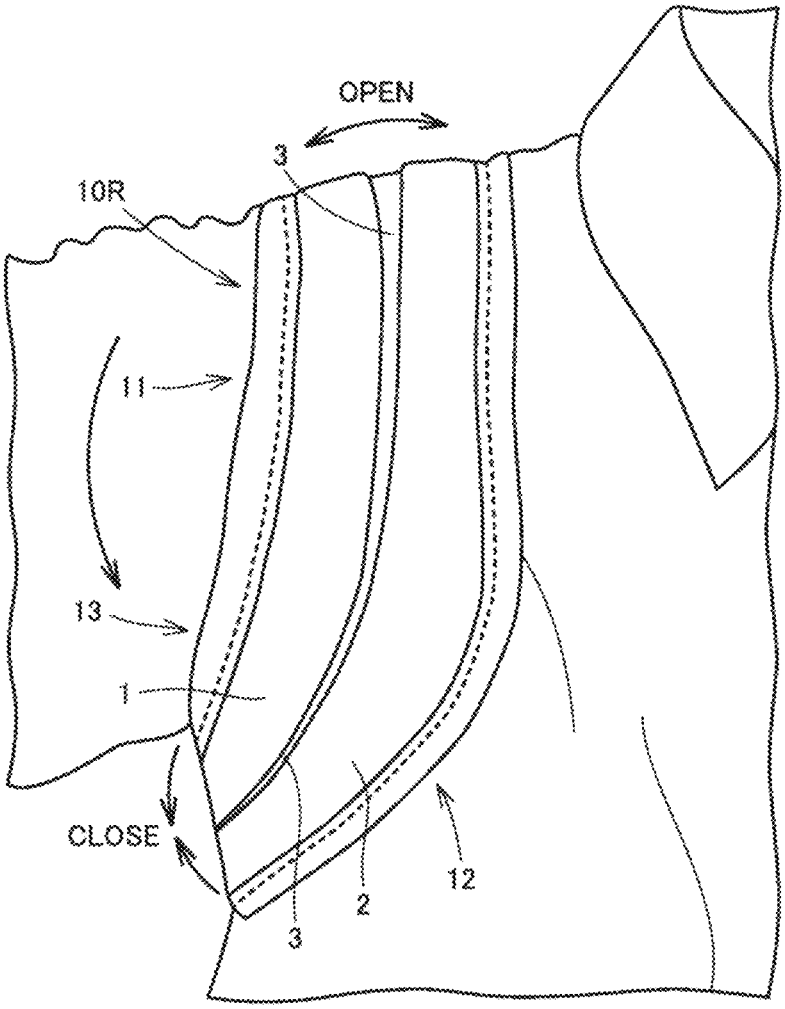
FIG. 15 is a view for describing a manner of deformation of the shoulder belt in a state where the wearer raises the arm passed through the shoulder belt according to the embodiment along the horizontal direction.
Figure 16:
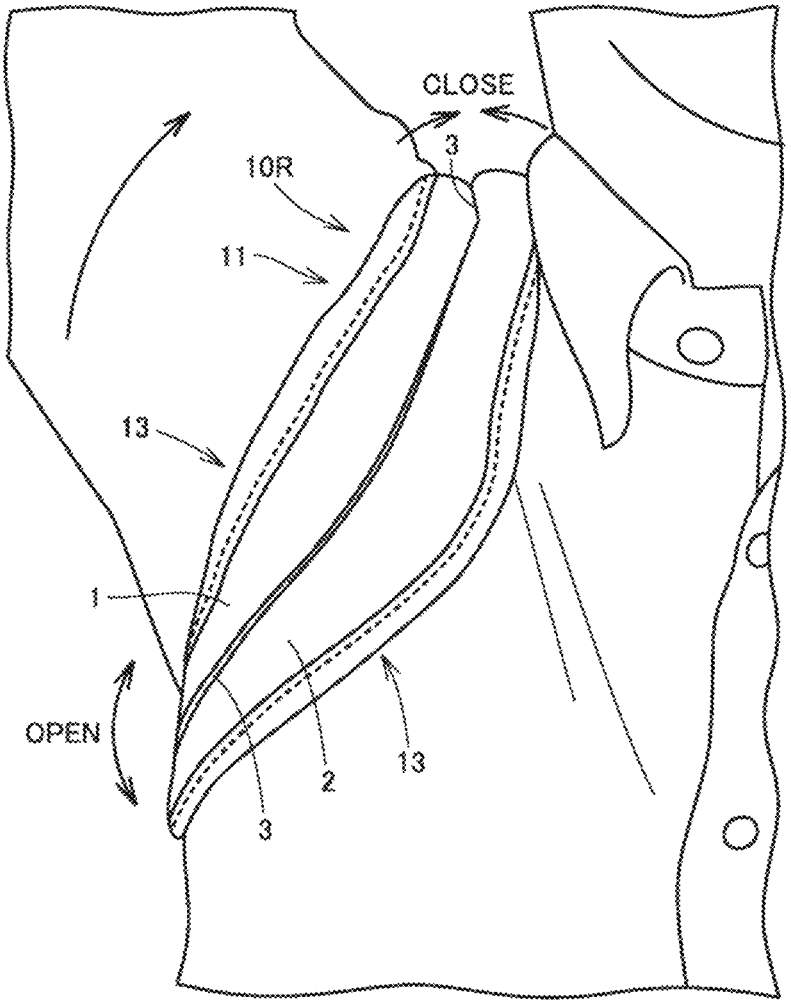
FIG. 16 is a view for describing a manner of deformation of the shoulder belt in a state where the wearer raises the arm passed through the shoulder belt according to the embodiment along the vertical direction.

As illustrated in FIG. 15, in the second state, third section 3 of first region 11 in contact with the shoulder linearly extends in the transverse direction, and thus first section 1 and second section 2 continuous with third section in the transverse direction can be opened in the transverse direction. On the other hand, as illustrated in FIG. 16, in the third state, third section 3 of first region 11 in contact with the shoulder is curved downward in a convex shape, and thus first section 1 and second section 2 continuous with third section 3 in the transverse direction can also be curved downward in a convex shape. Therefore, in the third state, first section 1 and second section 2 can be closed in the transverse direction as compared with the second state. As described above, in shoulder belts 10L, 10R, and 10, first region 11 can follow the change in the three-dimensional shape of the shoulder in each of the second state and the third state, and thus a contact area between first region 11 and the shoulder is increased.

Further, as illustrated in FIGS. 15 and 16, in the second state and the third state, second region 12 passed through under the arm shows a behavior opposite to a behavior of first region 11 in contact with the shoulder. Specifically, as illustrated in FIG. 15, in the second state, third section 3 of second region 12 passed through under the arm contracts in the transverse direction. As a result, in shoulder belts 10L, 10R, and 10, in the second state, second region 12 hardly bites into the armpit and interferes with the arm and the flank while sufficiently securing a contact area with the flank. Meanwhile, as illustrated in FIG. 16, in the third state, third section 3 of second region 12 passed through under the arm extends along the transverse direction. As a result, in shoulder belts 10L, 10R, and 10, the contact area between second region 12 and the flank is sufficiently secured in the third state, and thus a behavior of bags 100 and 110 is stabilized in the dynamic state.

It should be understood that the embodiment disclosed herein is illustrative in all respects and not restrictive. The scope of the present invention is defined not by the above description but by the claims, and is intended to include meanings equivalent to the claims and all modifications within the scope.

REFERENCE SIGNS LIST

1: first section, 1*a*, 2*a*: core material, 1*b*, 2*b*: packaging material, 1*b*1, 2*b*1: front surface, 1*b*2, 2*b*2: reverse surface, 1*b*3, 2*b*3: outer edge, 2: second section, 3, third section, 3*a*: first portion, 3*b*: second portion, 3*c*: third portion, 5: linking member, 6*a*, 7*a*: sewing member, 10, 10L, 10R: shoulder belt, 11: first region. 12: second region, 13: third region, 14: fourth region, 100, 110: bag, 101: body compartment, 102: tape

The invention claimed is:

1. A shoulder belt having a longitudinal direction and a transverse direction intersecting the longitudinal direction, the shoulder belt comprising:

a first section and a second section spaced apart from each other in the transverse direction in a cross section intersecting the longitudinal direction;

a third section connecting between the first section and the second section, wherein the first section, the second section, and the third section extend in the longitudinal direction from a first region to a second region, wherein the first region is configured to contact at least one of a shoulder or an upper part of a chest of a wearer and the second region is configured to contact a flank of the wearer;

a third region disposed between the first region and the second region;

a fourth region connected to an opposite side of the second region with respect to the third region in the longitudinal direction, wherein;

the first section, the second section, and the third section are independent members from each other and extend along the longitudinal direction, the third section has an expansion and contraction ratio that is higher than each expansion and contraction ratio of the first section and the second section, the third section has bending resistance that is lower than each bending resistance of the first section and the second section, a first end of each of the first section, the second section, and the third section, in the longitudinal direction, is connected to the fourth region, and a second end of each of the first section, the second section, and the third section, in the longitudinal direction, extends to the end of the first region opposite of the third region.

2. The shoulder belt according to claim 1, wherein the third section includes:

a first portion disposed inside of the first section and connected to the first section, a second portion disposed inside of the second section and connected to the second section, and a third portion disposed outside of the first portion and the second portion and connecting the first portion and the second portion to each other.

3. The shoulder belt according to claim 2, wherein the first section and the second section each includes:

a core material disposed to overlap at least a part of the first portion or a part of the second portion in plain view, and a packaging material disposed to surround the first portion or the second portion and the core material in the cross section and fixed to the first portion or the second portion.

4. A bag comprising:

the shoulder belt described in claim 1; and a body compartment fixed to the shoulder belt.

5. A bag comprising:

the shoulder belt described in claim 2; and a body compartment fixed to the shoulder belt.

6. A bag comprising:

the shoulder belt described in claim 3; and a body compartment fixed to the shoulder belt.

7. The shoulder belt according to claim 1, wherein the third region is configured to contact at least one of a lower part of the chest or the flank of the wearer.

8. The shoulder belt according to claim 1, wherein the fourth region further comprises at least one linking member.

* * * * *